US006443660B1

(12) United States Patent
Smith et al.

(10) Patent No.: US 6,443,660 B1
(45) Date of Patent: Sep. 3, 2002

(54) METHOD AND SYSTEM FOR MANIPULATING AN OBJECT LOCATED UNDERWATER

(75) Inventors: Perry Smith, Odenton, MD (US); Mark van Emmerik, Millersville, MD (US); Jeff Ledda, Prince Frederick, MD (US); Steve Wright, Tampa, FL (US); Bruce D. Caldwell, Jenner, CA (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 09/723,124

(22) Filed: Nov. 27, 2000

(51) Int. Cl.[7] ..... E02D 5/74; B63C 7/00

(52) U.S. Cl. ..... 405/224; 405/222; 405/224.1; 405/191; 114/44; 114/51; 114/244

(58) Field of Search ..... 405/160, 170, 405/172, 173, 222, 223, 224, 224.1, 226, 227; 114/44, 50, 51, 54, 244, 248, 254; 254/269, 362, 323, 264

(56) References Cited

U.S. PATENT DOCUMENTS 1,912,428 A * 6/1933 Bontempi ..... 114/53
3,267,682 A * 8/1966 Robley ..... 405/170
3,578,233 A * 5/1971 Meister et al. ..... 405/170 X
3,641,777 A * 2/1972 Banjavich et al. ..... 405/170 X
3,691,977 A * 9/1972 Eubanks et al. ..... 114/51
3,964,653 A * 6/1976 Strutz ..... 224/257
4,051,797 A * 10/1977 Hausmann ..... 114/51
4,197,033 A * 4/1980 Gendron ..... 405/170
4,203,687 A * 5/1980 Sumner ..... 405/170
4,318,641 A 3/1982 Hogervorst
4,319,372 A 3/1982 Tausig
4,432,671 A 2/1984 Westra et al.
4,575,282 A * 3/1986 Pardue, Sr. et al. ..... 405/224 X
4,658,745 A 4/1987 Buecher
4,725,398 A * 2/1988 Ruckey et al. ..... 376/270
4,744,698 A * 5/1988 Dallimer et al. ..... 405/224 X
5,143,266 A * 9/1992 Heckerman et al. ..... 224/150
5,263,796 A * 11/1993 de Waal ..... 405/172
5,551,801 A 9/1996 Gallaher et al.
5,593,250 A 1/1997 Smith et al.
5,655,938 A 8/1997 Huguenin et al.
5,666,898 A * 9/1997 Bell ..... 114/51 X
5,741,089 A 4/1998 Gallaher et al.
5,820,109 A 10/1998 Jermyn et al.

FOREIGN PATENT DOCUMENTS

GB 2193776 * 2/1988 ..... 405/169

* cited by examiner

*Primary Examiner*—Heather Shackelford
*Assistant Examiner*—Jong-Suk Lee
(74) *Attorney, Agent, or Firm*—Duane Morris LLP

(57) ABSTRACT

An apparatus for manipulating an object located proximate an underwater floor is disclosed, in a preferred embodiment comprising a foundation implantable in the underwater floor; a lifting frame extending between the foundation; and a multiplicity of slings mounted adjacent to each other and attached to the lifting frame such that each of the slings is suspended in a cradle-like configuration from the lifting frame. Each of the slings further comprises a top surface facing away from the underwater floor and a padding material mounted proximate the top surface of each sling. The foundation may further comprise suction piles. A monitoring system comprising instrumentation may also be used to aid in guiding the load transfer of the object from the floor to the lifting frame. A method of lifting is described comprising lowering and securing the foundation into the underwater floor proximate the object to be retrieved, positioning the lifting frame proximate the object to be retrieved, installation of containment material, securing lifting frame ends onto the foundation, securing each end of each sling onto the lifting frame as well as positioning each sling under the object to be retrieved, tensioning each sling, and then raising the object by raising the lifting frame.

20 Claims, 7 Drawing Sheets

METHOD AND SYSTEM FOR MANIPULATING AN OBJECT LOCATED UNDERWATER

BACKGROUND OF THE INVENTION

1. Field of the Invention

The present invention relates to manipulating objects located proximate an underwater floor. By way of further particularity, the present invention relates to an apparatus and method of using the apparatus for salvage and recovery of fully or partially submerged objects. By way of further particularity, the present invention relates to an apparatus and method for recovering fully or partially submerged objects from an underwater floor such as a seabed, lake, river, or marsh, especially in operations having delicate or difficult archeological retrieval characteristics.

2. Description of the Related Art

There are numerous patents in the field of underwater salvage and recovery systems and methods. As summarized below, these patents neither teach nor suggest use of a support foundation implanted or otherwise imbedded in an underwater floor such as a seabed or having a lifting frame with a series of slings that are suspended from the lifting frame in a cradle-like configuration.

U.S. Pat. No. 4,658,745 issued to Beucher discloses a salvage apparatus that includes a drum container. The salvage apparatus 10 is taken by a diver from a surface craft to an object to be retrieved 12 from the ocean floor.

U.S. Pat. No. 5,820,109 issued to Jermyn, et al. discloses a salvage apparatus that includes a lift system 10. The lift system 10 has a flotation unit 18 having connection means to provide appropriate points on a harness 20 to provide for attachment of tethers. Means for attaching to and lifting underwater salvage items are disclosed.

U.S. Pat. No. 4,319,372 issued to Tausig discloses a salvage apparatus for delivering a heavy cable from the ocean's surface to an extended depth for attachment to an object to be salvaged. The apparatus 10 includes a buoyancy float 12 formed of a syntactic foam. The buoyancy float 12 further has a central longitudinal aperture 18 extended from a rounded top of the buoyancy float 12 to a substantially flat bottom of the buoyancy float 12.

U.S. Pat. No. 5,551,801 issued to Gallaher, et al. discloses a hyjack platform with compensated dynamic response. An offshore platform structure is disclosed for temporarily using a jack-up rig. Pile sleeves 20 support a truss assembly, e.g. surface tower 28. See also U.S. Pat. No. 5,741,089 issued to Gallaher, et al. and U.S. Pat. No. 5,593,250 issued to Smith, et al., each of which also disclose hyjack platforms and methods of use.

U.S. Pat. No. 5,655,938 issued to Huguenun, et al. discloses a variable buoyancy float/ballast system having a float/ballast assembly 23. A lower ballast portion 26 carries a fixed but adjustable ballast in modular increments. A floatation chamber 27 is attached to float/ballast assembly 23. When chamber 27 is flooded, float/ballast assembly 23 sinks, and when filled with air, float/ballast assembly 23 rises. One or more mooring lines attach to float/ballast assembly 23 and to an object to be raised such as cage 20.

DETAILED DESCRIPTION

The present invention relates to an apparatus for use in recovering objects such as objects that might be fully or partially submerged in a body of water such as a seabed or marsh, especially in operations having delicate or difficult archeological retrieval characteristics and/or where objects are fully or partially embedded into a floor of the body of water.

Figure 1:
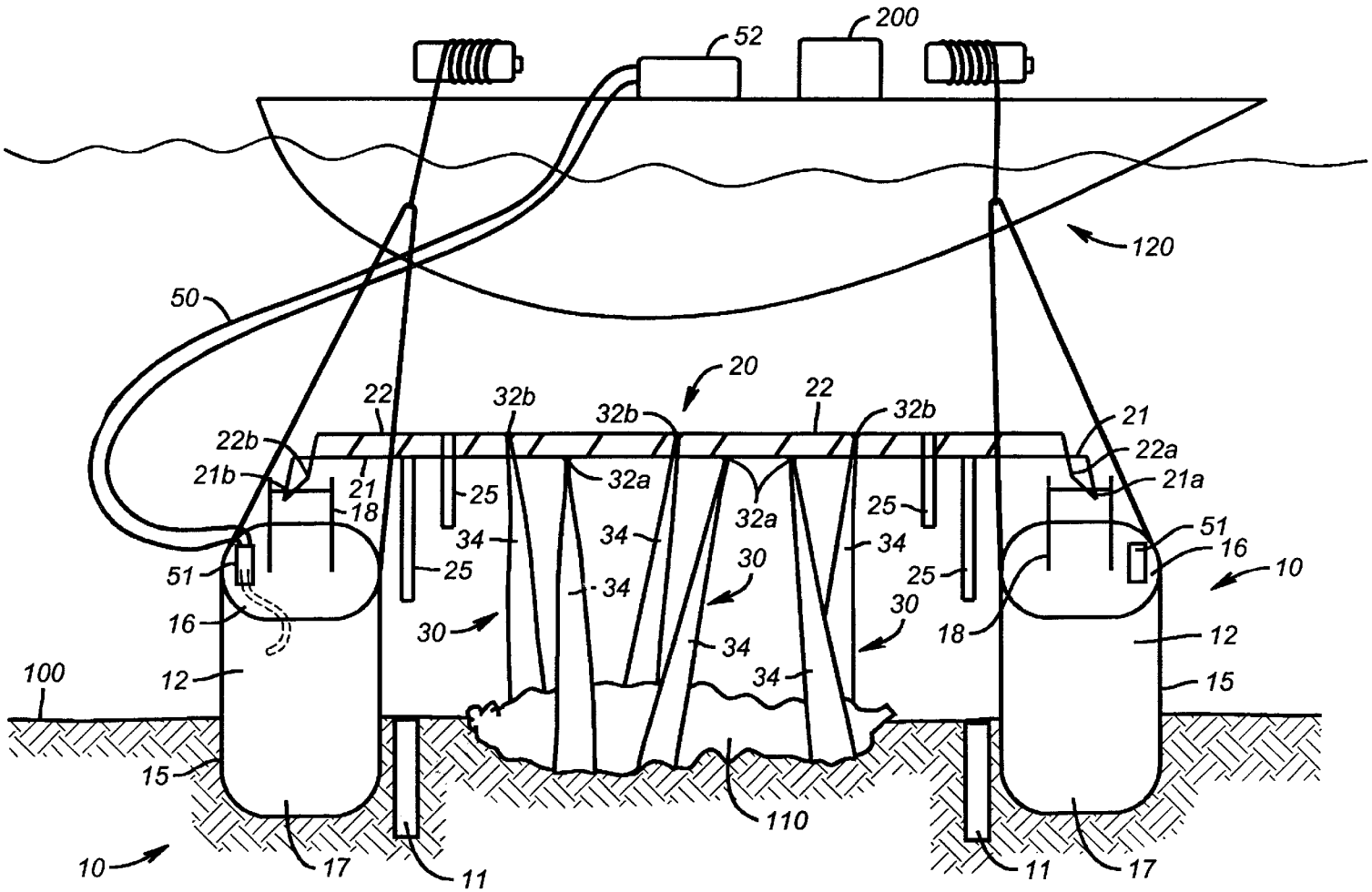
FIG. 1 is a plan view of a representative configuration of the salvage system of the present invention.

Referring now to FIG. 1, the present invention's system comprises foundation 10, lifting frame 20, and rigging system 30.

Foundation 10 may be constructed from any material appropriate for use underwater. It is understood that the underwater environment may be fresh water, salt water, brackish water, marshes, or any combination thereof and that each underwater environment may present differing turbulence or tidal features. As opposed to the prior art use of similar foundations to support a tensile load such as to anchor a floating oil platform, foundation 10 of the present invention supports a compressive load.

Foundation 10 supports lifting frame 20 and comprises bearing table 18 as well as outer wall 15 and top surface 16 defining cavity 17 that is at least partially implantable into floor 100 where floor 100 is a seabed, lake floor, river bed, or the like. Bearing table 18 may be adjustable such as to allow for variations in position of lifting frame 20 into position onto foundation 10.

In the preferred embodiment, foundation 10 comprises a pair of suction piles 12, similar to those used in oilfield operations as will be familiar to those of ordinary skill in offshore platform construction arts. Examples of similar suction piles may be seen in U.S. Pat. No. 4,432,671 issued to Westra et al. and U.S. Pat. No. 4,318,641 issued to Hogervorst. Outer wall 15 of suction pile 12 provides for skin friction load bearing and top surface 16 may bear directly on floor 100. Suction piles 12 are positioned to a predetermined position on floor 100 proximate object 110. In the preferred embodiment, suction piles 12 comprise welded A36 steel, but, by way of example and not limitation, can further comprise general purpose mild steel or any other material capable of supporting lifting frame 20 and its loads. The actual dimensions of suction piles 12 may vary depending on the actual or presumed characteristics of floor 100 including the depth of floor 100, as will be familiar to those of ordinary skill in the underwater construction arts.

Alternatively, foundation 10 may be a sufficiently supportive floor 100. Suction pile 12 is preferred when floor 100 is of unknown load bearing ability. However, if floor 100 is sufficiently firm, a "mud mat" such as a concrete mat (not shown in the figures) may be used to more or less conform to or lay flat on floor 100 to support the weight of lifting frame 20 and object 110. Mud mats may comprise steel, concrete, wood, or any combination of materials that sinks and can provide sufficient support for lifting frame 20 and object 110.

Alternatively, foundation 10 may be a sufficiently supportive floor 100. Suction pile 12 is preferred when floor 100 is of unknown load bearing ability. However, if floor 100 is sufficiently firm, a "mud mat," generally referred to by the numeral "11," such as a concrete mat 11 may be used to more or less conform to or lay flat on floor 100 to support the weight of lifting frame 20 and object 110. Mud mats 11 may comprise steel, concrete, wood, or any combination of materials that sinks and can provide sufficient support for lifting frame 20 and object 110.

In the preferred embodiment, submersible hydraulic pump 51 has an approximately 4" diameter inlet pipe mated to an approximately 4" pipe stub welded in through top surface 16 of suction pile 12. Alternatively, submersible hydraulic pump 51 may be electrically or pneumatically actuated, and alternatively may be located on a deck of vessel 120, a platform , or another suitable structure such as a river bank, providing that pump 51 has sufficient power to create a differential pressure needed to drive suction pile 12 into floor 100.

Lifting frame 20 is a structure to be supported by foundation 10. Lifting frame 20 may be configured as a truss or any other appropriate structure, all of which will be readily understood by those of ordinary skill in the structural design arts. In a preferred embodiment, lifting frame 20 is a light weight truss whose length is at least equal to that of object 110.

In the preferred embodiment, lifting frame 20 further comprises a first longitudinal member 21 and a second longitudinal member 22 where longitudinal members 21, 22 are spaced apart a distance greater than or equal to the width of object 110. However, lifting frame 20 may comprise a single longitudinal member such as longitudinal member 21 or have any predetermined shape capable of supporting object 110 during lifting, by way of example and not limitation such as a substantially rectangular shape.

Lifting frame 20 may be made of any material appropriate to withstand the fluid and chemical environment into which lifting frame 20 may be submerged. In a preferred embodiment for salt-water use, lifting frame 20 comprises a suitable grade of steel such as 500 grade steel which has greater material strength that the material used for suction piles 12. In alternative embodiments, lifting frame 20 may comprise any material appropriate in light of factors relevant to object 110 and its environment, by way of example and not limitation including the weight and condition of object 110, the distance between foundation 10 components, the number and location of rigging connections between object 110 and lifting frame 20, and water current forces.

Once lowered into place, ends 21*a*, 22*a*, 21*b*, and 22*b* of lifting frame 20 are supported on foundation 10 and lifting frame 20 fixed in place such as by securing ends 21*a*, 22*a*, 21*b*, and 22*b*. Alternatively, securing ends 21*a*, 22*a*, 21*b*, and 22*b* may rest on foundation 10, secured by the weight of lifting frame 20 onto foundation 10. In a currently preferred embodiment, lifting frame 20 is supported by adjustable bearing table 18 to account for foundation misalignment of plumb, altitude, placement, and/or rotation, and is chained to foundation 10 to secure it to foundation 10. Alternatively, lifting frame 20 may further comprise bolt holes located within or proximate to lifting frame 20 bearing seats (not shown in the figures) that land on foundation 10 on bearing table 18. Preconfigured bolt holes may exist in bearing table 18 to receive one or more through bolts where the through bolts also pass through lifting frame 20 bolt holes. In an alternative embodiment, bolt holes may be drilled or otherwise created in mounting table 18 to receive through bolts. As will be apparent to those of ordinary skill in the construction arts, lifting frame 20 may also be secured to foundation 10 by chains, bolts, locking latches, pin-and-box, ball-and-socket, or any other appropriate connectors.

Sling securing ends, generally referred to by the numeral "32" in the figures and shown as sling securing ends 32*a* and 32*b* in FIG. 1, are disposed about lifting frame 20. In a preferred embodiment, sling securing ends 32 connect padeyes 27 running the length of lifting frame 20. In a currently preferred embodiment, padeyes 27 are secured to lifting frame 20 as by welding or other securing means, all of which will be understood by those of ordinary skill in the fabrication arts.

Rigging system 30 comprises at least one sling 34 secured to lifting frame 20 using sling ends 32 such as by attachment to padeyes 27. In a currently preferred embodiment, sling 34 comprises a multiplicity of slings 34 mounted adjacent to each other where each of slings 34 has a first end 34*a* attached to first longitudinal member 21 at sling securing end 32*a* and a second end 34*b* attached to second longitudinal member 22 at sling securing end 32*b*, such that, once attached to lifting frame 20, each of slings 34 is suspended in a cradle-like configuration from lifting frame 20.

Figure 2:
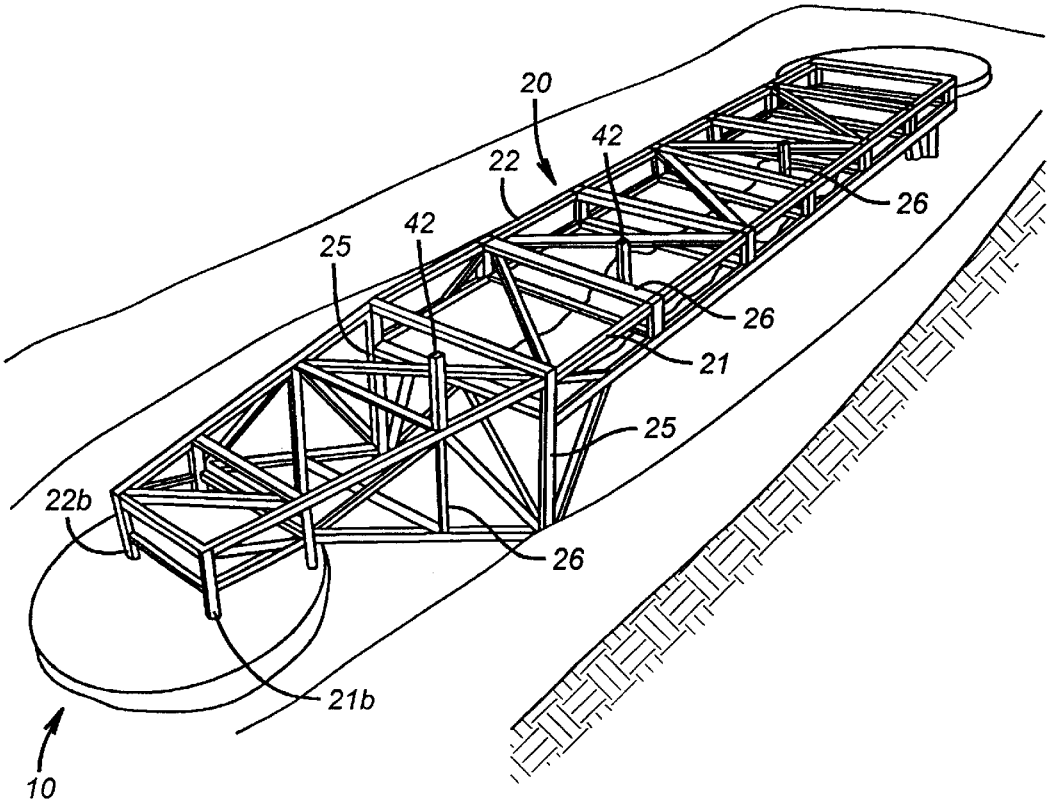
FIG. 2 is a plan perspective view of a representative lifting frame.

Referring now to FIG. 2, lifting frame 20 may be configured as a truss with a plurality of longitudinal members 21, 22, a plurality of support legs 25, and a plurality of ribs 26. If floor 100 is sufficiently supportive, foundation 10 maybe eliminated and lifting frame 20 secured directly onto floor 100 or other support structures such as mud mats such as by support legs 25. In situations, length of support legs 25 may be adjustable such as to account for irregularities in floor 100.

In alternative embodiments, one or more measurement gauges such as strain gauges, tension gauges, sonic, and/or linear variable displacement transducers or "LVDTs" 42 may also be present. In a presently preferred embodiment, LVDT 42 is a tubular further comprising rod 42*a* (not shown in the figures) movably mounted within LVDT 42. Rod 42*a* may contact object 110 such as by gravity or other attaching means. The movement of rod 42*a* within LVDT 42 induces a current within a sensing loop such as by a disturbance in a magnetic field. Current may then be passed to monitoring equipment to sense the current. In an alternative embodiment, rod 42*a* may be calibrated and monitored visually.

Figure 3:
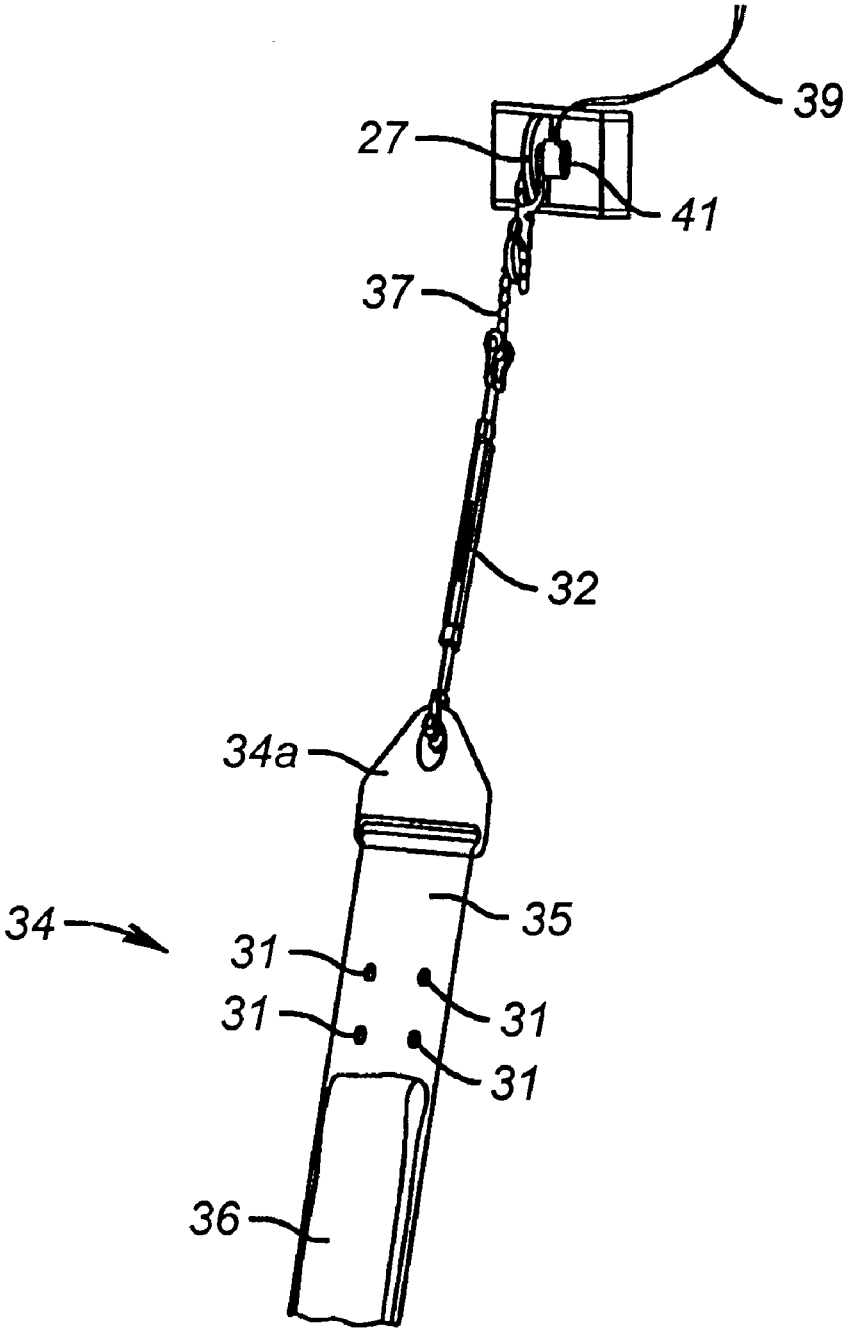
FIG. 3 is a plan perspective view of a representative sling.
Figure 4:
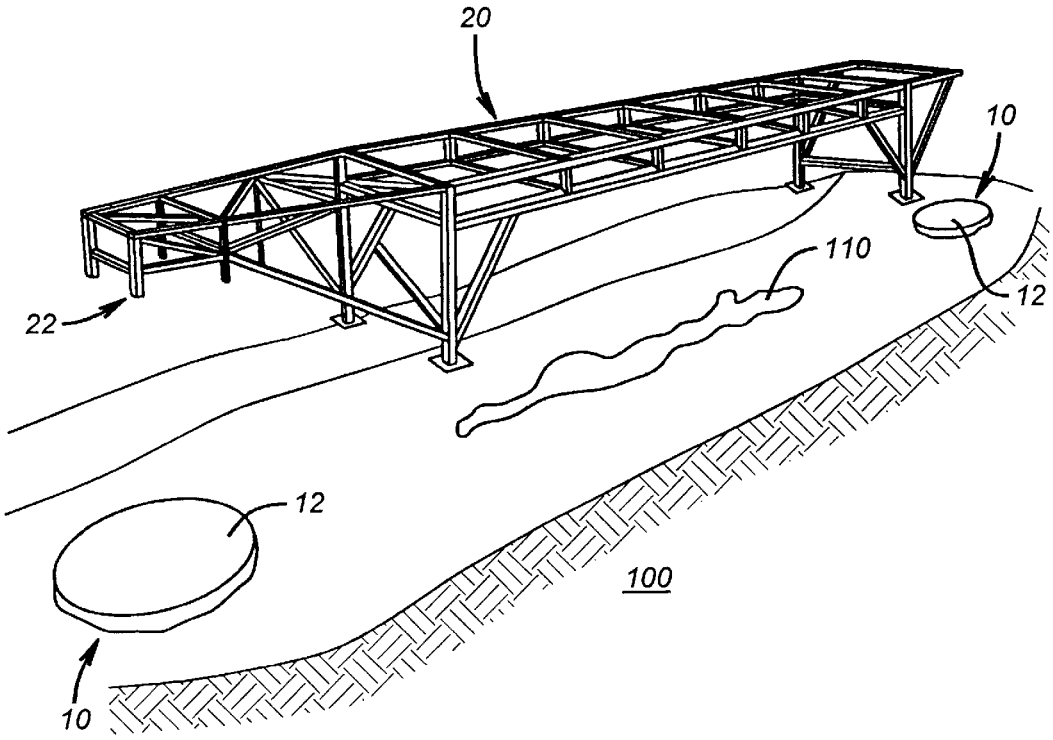
FIG. 4 is a plan perspective view of a representative lifting frame being lowered into place over a partially embedded object to be retrieved.

Referring now to FIG. 3, each sling 34 further comprises top surface 35 facing away from floor 100. Slings 34 may further comprise buffering and securing components, including by way of example and not limitation buffer bags 36 such as nylon buffer bags located proximate top surface 35, tensioning hardware such as turnbuckles 32 and chains 37, and monitoring instrumentation 41 (not shown in the figures) suitable to aid in guiding the load transfer of object 110 from floor 100 to lifting frame 20. Buffer bag 36 provides a cushioning contact area that will conform to an surface geometry of object 110.

In a preferred embodiment, slings 34 comprise nylon slings that range from around 8" to around 18", but the actual dimensions of slings 34 may vary depending on the actual object 110 to be retrieved. Slings 34 may further comprise hole pattern 31 for attaching buffer bags 36. Bag fasteners 33

(not shown in the figures) may be used to attach buffer bags 36 to sling 34 by any appropriate means, such as rope, cord, monofilament lines, fasteners, hooks and loops, small lines, cable ties, and the like, or any combination thereof.

"Secondary" slings 34 may be used to minimize stress in object 110 and provide general flexibility in securing object 110. Secondary slings 34 are distinguished from other slings 34 by usage. By way of example and not limitation, where object 110 has structural characteristics indicating points of weakness along object 110, secondary slings 34 may be used as a precaution to reduce the stress induced in object 110. Secondary slings 34 may be attached to lifting frame 20 such as at sling ends 34*a*, 34*b* or to other slings 34. Thus, in situations where object 110 could have compromised or questionable structural integrity, and/or disarticulated or fractured features, secondary slings 34 may be used to provide additional, ancillary support as opposed to main lifting support of other slings 34.

In the presently preferred embodiment, a single buffer bag 36 comprising a nylon mesh adapted to receive and retain a fluid therein is disposed proximate top surface 35. Each buffer bag 36 may be independent of any other buffer bag 36 and each may be independently fillable with fluid. In an alternative embodiment, buffer bags 36 may further comprise injector ports adapted to receive and retain fluids. Further, the present invention can be satisfied with a single buffer bag 36 whether independent of or integrated into sling 34, a plurality of buffer bags 36 whether independent of or integrated into sling 34, or any combination thereof. In a currently envisioned alternative embodiment, buffer bags 36 may be preformed out of a material such as out of a neoprene material to a desired conforming shape before attaching buffer bags 36 to slings 34.

A tensioning system for each sling 34 may be present as well, and may further comprise turnbuckles 32, chains 37, load cells 41, and vertical measurement gauges ("LVDTs") 42 (shown in FIG. 2). In an alternative embodiment, the tensioning system may employee ratchet type tensioners, chain binders, and cable slings, as will be familiar to those in the construction arts. Load cells 41 and LVDTs 42 may be further connected by an appropriate signaling means such as a wire or optical pathway 39 to instrumentation such as data recording and display systems (not shown in the figures) located at vessel 120 or a surface such as a river bank. Pathway 39 may thus be used to relay information about tension in sling 34 and other monitored data to data recording and display systems such as by way of example and not limitation to general purpose computers, special purpose computers, digital readout devices, analog readout devices, or the like, or any combination thereof.

A tensioning system for each sling 34 may be present as well, and may further comprise turnbuckles 32, chains 37, load cells 41, and vertical measurement gauges ("LVDTs") 42 (shown in FIG. 2). In an alternative embodiment, the tensioning system may employee ratchet type tensioners, chain binders, and cable slings, as will be familiar to those in the construction arts. Load cells 41 and LVDTs 42 may be further connected by an appropriate signaling means such as a wire or optical pathway 39 to instrumentation such as data recording and display systems 200 (FIG. 1) located at vessel 120 or a surface such as a river bank. Pathway 39 may thus be used to relay information about tension in sling 34 and other monitored data to data recording and display systems such as by way of example and not limitation to general purpose computers, special purpose computers, digital readout devices, analog readout devices, or the like, or any combination thereof.

Lifting frame 20 is then positioned into place onto foundation 10 proximate object 110 such as by lowering it from vessel 120, and lifting frame ends 22 are then secured onto foundation 10. In a preferred embodiment, lifting frame ends 22 are secured such as by chains secured through padeyes 27 that may be present in bearing table 18. When secured onto foundation 10, lifting frame 20 is positioned in a predetermined position proximate object 110 suitable for lifting object 110 in support structure.

In an alternative embodiment, foundation 10 may be preassembled with lifting frame 20 before lowering foundation 10 and lifting frame into the water.

Figure 5:
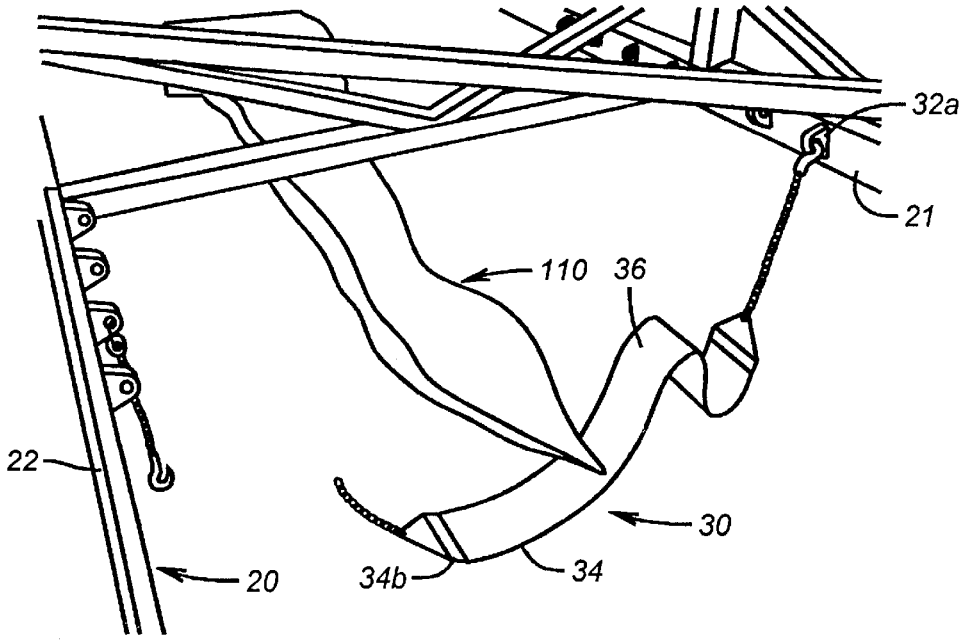
FIG. 5 is a plan perspective view of a representative sling being positioned under a partially embedded object to be retrieved.
Figure 6:
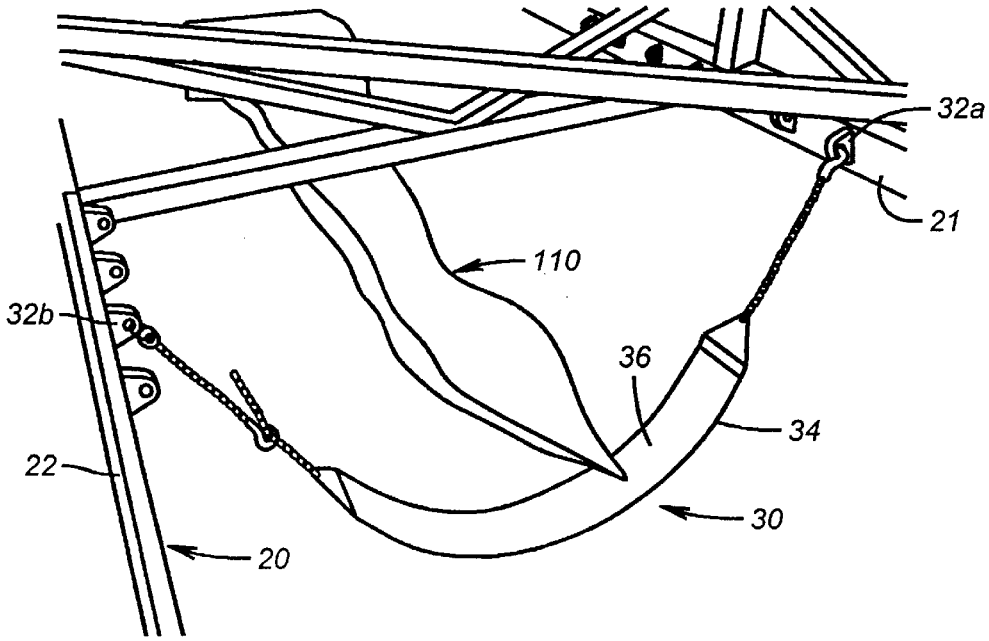
FIG. 6 is a plan perspective view of a representative sling being attached to a representative lifting frame.

Referring now to FIG. 5 and FIG. 6, once lifting frame 20 is secured onto foundation 10, each sling 34 to be used during the salvage operation is attached to first longitudinal member 21 at sling securing end 32*a* and then draped or otherwise positioned under object 110. Floor 100 material may be partially excavated from near and/or under object 110 to facilitate draping or otherwise positioning sling 34 under object 110. Second end 34*b* of sling 34 is then retrieved from under object 110 and then attached to second longitudinal member 22 at sling securing end 32*b*, such that each of slings 34 is suspended in a cradle-like configuration from lifting frame 20 under object 110. In a currently preferred embodiment, excavation can occur in a progressive manner, such that the load of object 110 is transferred incrementally. As each incremental tension step occurs, additional excavation may then take place.

Figure 7:
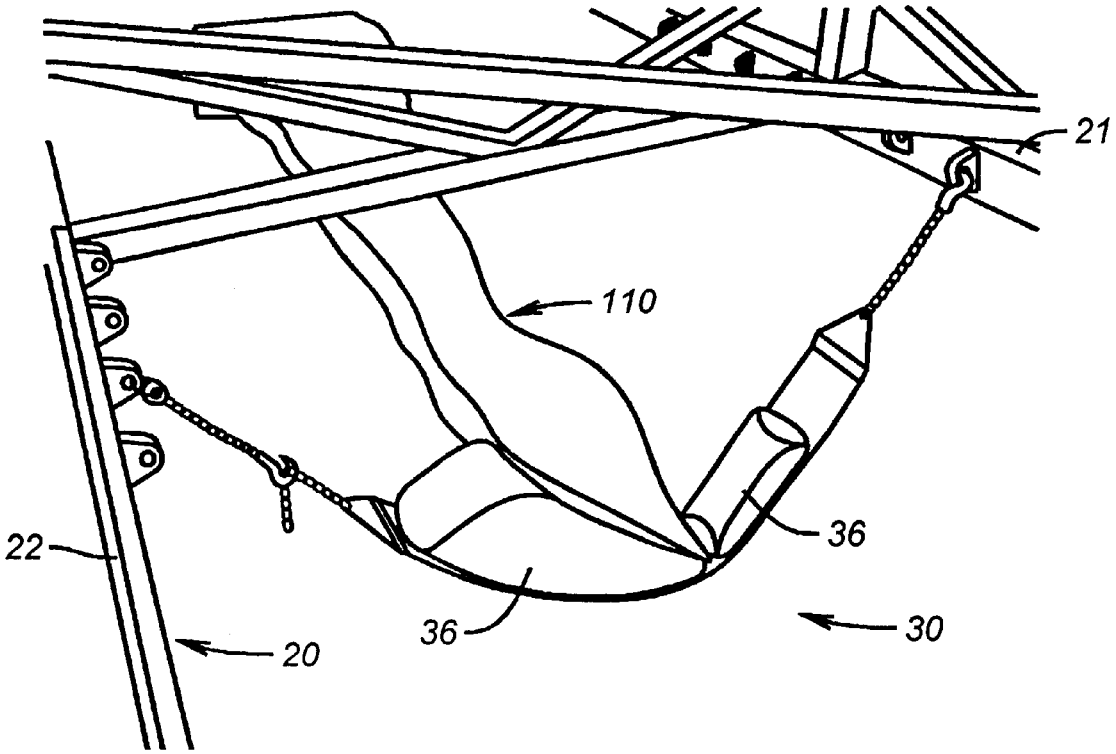
FIG. 7 is a plan perspective view showing buffer bags being inflated.

Referring now to FIG. 7, if not already attached, buffer bags 36 are attached such as by lacing to each sling 34 using hole patterns 31 and bag fasteners 33. Alternatively, buffer bags 36 may have already been placed onto sling 34 or sling 34 may be integral with buffer bags 36. Buffer bags 36 are then injected with a predetermined fluid, by way of example and not limitation directly through an outer surface of buffer bag 36 or through an injector port. In the preferred embodiment, the fluid used is a two part industrial polyurethane foam commonly used in the insulation and refrigeration industry. One such foam is FROTH-PAK(TM), produced by Flexible Products, 1007 Industrial Park Drive, Marietta, Ga. 30062. It is anticipated that standard foam hoses and foam injection guns can be used to inject the fluid into buffer bags 36, and that manual as well as mechanized or other pressurized means such as pressure tanks, compressors, and the like may be used. Further, although a single buffer bag 36 may be used, a plurality of buffer bags 36 may be used to better conform to the shape of object 110.

If a foam is used as in the preferred embodiment, the foam may be inserted into buffer bag 36 by inserting a nozzle tip of the foam injection gun directly into buffer bags 36 and injecting foam until each buffer bag 36 conforms to object 110 or otherwise appears full to the person injecting the foam. In an alternative embodiment, buffer bag 36 further comprises one or more injector ports into which the nozzle tip may be inserted. The foam may then be allowed to harden.

Figure 8:
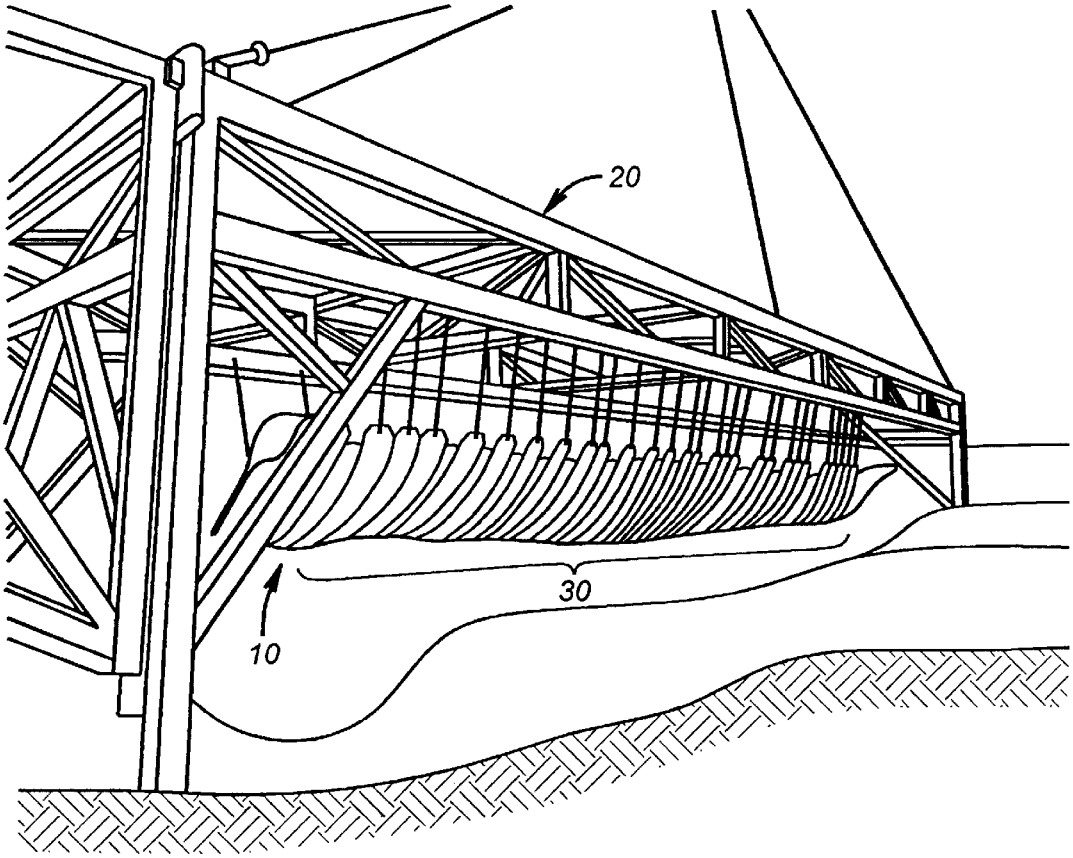
FIG. 8 is a plan perspective view showing a plurality of slings deployed under an object as the object is being lifted.

Referring now to FIG. 8, once each sling 34 is positioned and buffer bags 36 filled, each sling 34 is tensioned to transfer the weight of object 110 to lifting frame 20 and foundation 10. Numerous means of tensioning may be used as will be familiar to those of ordinary skill in the structural arts, including by way of example and not limitation use of turnbuckles 32 attached to one or more ends of sling 34, or rachet type tensioners comprising straps secured on one side with hooks, passed under buffer bags 36, and threaded into spools in a support bracket. The spools may be turned such as with a lever or other extension to tighten the straps against the load to hold it in place.

Slings 34 are tensioned using the tensioning system. Tension may be estimated initially or the tensioning system may be used to adjust the tension for each sling 34. Once object 110 is secured, such as when all slings 34 are tensioned, lifting frame 20 is released from foundation 10, if secured to foundation 20, and lifting frame 20 is then lifted, along with object 110. As object 110 is lifted, tensioning may be further adjusted, either manually, automatically, or a combination thereof. Once fully retrieved, lifting frame 20 may be secured onto a surface such as a ship or barge deck by using support legs 25. Alternatively, lifting frame 20 may be positioned onto a cradle on a surface such as a ship or barge deck where the cradle is preconfigured to accept lifting frame 20 and object 110 suspended in slings 34.

In a preferred embodiment, LVDTs 42 allow monitoring of bending of object 110. Thus, during tensioning and/or lifting, if monitors determined that the bending is excessive, LVDTs 42 will indicate where the tensioning needs to be adjusted. Divers may be instructed on tension adjustments during the lifting from monitors such as by radio, direct linkage, or other means as are well known in the diving arts. In addition, tension adjustments may be made automatically through automated means using data gathered by a data recording and display system (not shown in the figures). It is understood that as used herein above, "monitors" may be human beings, automated systems, or any combination thereof.

Suction piles 12 may be retrieved after use by reversing the installation procedural steps.

In addition to using the apparatus and method of the present invention for salvage and retrieval operations, the present invention may also have use in other underwater endeavors. By way of example and not limitation, the current example can be used to manipulate pipeline equipment such as underwater tubulars, underwater telephony cables, valve assemblies, other underwater structures such as pumps or electro-mechanical machinery, and the like, or any combination thereof. Such usage may also include manipulation of underwater objects for installation, maintenance, and repair operations as well as salvage and/or removal. These are by way of example and illustration only as the scope of the invention is described by the claims herein.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A system for manipulating an object located underwater, comprising:

a) a foundation implantable in an underwater floor;

b) a lifting frame having a first end and a second end, each adapted for mounting on the foundation, the lifting frame further comprising a first longitudinal member and a second longitudinal member extending between the first and second ends, the longitudinal members being spaced apart a predetermined distance;

c) a multiplicity of slings mounted adjacent to each other, each of the slings having a first end attachable to the first longitudinal member and further having a second end attachable to the second longitudinal member, such that, when attached to the first longitudinal member and second longitudinal member, each of the slings is suspended in a cradle-shaped configuration from the lifting frame, each of the slings further comprising a top surface facing away from the underwater floor; and d) a padding material mounted proximate the top surface of each sling.

2. The system of claim 1 wherein the lifting frame further comprises a plurality of support legs and support ribs.

3. The system of claim 1 wherein the spacing of a predetermined distance of the longitudinal members is at least equal to a width of the object sought to be manipulated.

4. The system of claim 1 wherein the padding material comprises at least one buffer bag adapted to receive a fluid.

5. The system of claim 4 wherein the fluid is an expansive foam.

6. The system of claim 1 wherein the foundation further comprises:

a) a first suction pile implantable in the underwater floor, the first suction pile having an outer wall and a top surface defining an interior void that is at least partially implanted into the underwater floor; and b) a second suction pile implantable in the underwater floor, the second suction pile having an outer wall and a top surface defining an interior void that is at least partially implanted into the underwater floor, the second suction pile being positioned a predetermined distance from the first suction pile;

wherein the lifting frame extends between the first and second suction piles, the lifting frame having a first end adapted for mounting on the first suction pile and further having a second end adapted for mounting on the second suction pile; and the predetermined distance between the first and second suction piles exceeds a length of the object sought to be recovered from the underwater floor.

7. The system of claim 6 further comprising a submersible hydraulic pump operatively connected to a hydraulic power unit through at least one fluid hose, the hydraulic pump further operatively connected to an inlet in at least one of the suction piles, whereby the hydraulic pump creates a differential pressure needed to drive the suction pile into the underwater floor.

8. The system of claim 6 wherein the first suction pile further comprises a bearing table disposed proximate the top surface of the first suction pile, and the second suction pile further comprises a bearing table disposed proximate the top surface of the second suction pile, wherein each of the bearing tables is adapted to receive either the first end or the second end of the lifting frame.

9. The system of claim 1 further comprising a tensioning system, the tensioning system comprising:

a) a tension adjuster disposed between each sling and the lifting frame;

b) a load cell operatively connected to a sling;

c) a vertical measurement gauge operatively in communication with the object;

d) a pathway; and e) a data recording and display system operatively connected to the pathway;

f) wherein the pathway is further operatively connected to and conveys data between at least one of the load cell or the vertical measurement gauge to the data recording and display system.

10. A system for lifting an object disposed proximate an underwater floor, where the density of the underwater floor can support a compressive load, the system comprising:

a) a lifting frame extending between a first foundation portion and a second foundation portion, the lifting frame having a first end adapted for mounting on the underwater floor and further having a second end adapted for mounting on the underwater floor, the lifting frame further comprising at least one object lifting support member;

b) a multiplicity of slings mounted adjacent to each other, each of the slings further comprising:

i) a first end attached to the object lifting support member;

ii) a second end attached to the object lifting support member;

iii) a top surface facing away from the underwater floor; and iv) a padding material mounted proximate the top surface of each sling.

c) wherein i) each of the slings is suspended in a cradle-shaped configuration from the lifting frame and ii) the padding material is disposed intermediate the object and the sling.

11. The system of claim 10 wherein the object lifting support member further comprises a first longitudinal member and a second longitudinal member extending between the first and second ends, the longitudinal members being spaced apart a distance greater than or equal to the width of the object sought to be recovered.

12. The system of claim 10 further comprising at least one mud mat deployable on the underwater floor, the mud mat being capable of supporting the lifting frame during at least an initial lifting of the object.

13. A method of manipulating an object that is at least partially underwater with an apparatus comprising a lifting frame comprising a first longitudinal member, a second longitudinal member, and first and second lifting frame ends adapted for mounting on a foundation; and at least one sling adapted to receive padding material; the method comprising:

a) positioning the lifting frame proximate an object to be retrieved from an underwater floor;

b) securing one end of the at least one sling onto the first longitudinal member of the lifting frame;

c) positioning the at least one sling under the object to be retrieved, the at least one sling further positioned adjacent to at least one other sling;

d) retrieving a free end of the least one sling from under the object to be retrieved;

e) securing the free end of the at least one sling onto the second longitudinal member of the lifting frame;

f) disposing padding material intermediate the object and the at least one sling;

g) conforming a predetermined amount of padding material to the object;

h) tensioning the at least one sling; and i) raising the object by raising the lifting frame.

14. The method of claim 13 for a system further comprising a foundation, the method further comprising:

a) positioning the foundation onto the underwater floor proximate the object to be retrieved before positioning the lifting frame proximate an object to be retrieved from the underwater floor;

b) securing the foundation into the underwater floor before positioning the lifting frame proximate the object to be retrieved from the underwater floor; and c) securing the lifting frame to the foundation after positioning the lifting frame proximate the object to be retrieved from the underwater floor.

15. The method of claim 13 for a system further comprising a plurality of suction piles, each suction pile having a top surface and an outer wall defining an inner cavity, the method further comprising:

a) lowering each of the suction piles to a predetermined position proximate the object to be retrieved;

b) connecting a submersible hydraulic pump powered by hydraulic fluid pumped to it from a separate hydraulic power unit to a fluid supply hose and fluid return hose;

c) connecting the fluid supply hose and the fluid return hose to a predetermined number of the suction piles;

d) using the pump to remove the water from within the suction pile cavity, thereby creating a lower pressure inside the suction pile than outside the pile;

e) using the greater pressure outside the suction pile to create a force on the top surface of the suction pile to push the suction pile into the floor; and f) pumping water from inside the suction pile into water surrounding the suction pile until the suction pile is embedded in the floor to a predetermined depth.

16. The method of claim 15 for suctions piles further comprising bearing tables mounted proximate the top surface of at least one suction pile and adapted to receive an end of the lifting frame, the method further comprising securing the end of the lifting frame into an adapter portion of the bearing table adapted for receiving the end of the lifting frame.

17. The method of claim 13 wherein the padding material comprises a first predetermined number of buffer bags adapted to receive fluid, the method further comprising injecting a predetermined fluid into a second predetermined number of the buffer bags until the fluid attains a predetermined volume.

18. The method of claim 17 wherein the fluid is a foam fluid that hardens, the method further comprising allowing the foam fluid to harden in the second predetermined number of buffer bags prior to tension each sling.

19. The method of claim 13 for an apparatus further comprising a tension monitoring system, the method further comprising:

a) continually monitoring tension in at the least one sling; and b) adjusting the tension in the at least one sling prior to and/or during the raising of the object to achieve a desired tension.

20. The method of claim 13, further comprising:

a) positioning at least one mud mat proximate the object to be retrieved;

b) positioning the lifting frame proximate the object to be retrieved; and c) securing the lifting frame onto the mud mat.

* * * * *